US006873122B2

(12) United States Patent
Schmitt

(10) Patent No.: US 6,873,122 B2
(45) Date of Patent: Mar. 29, 2005

(54) APPARATUS FOR OPERATING DISCHARGE LAMPS

(75) Inventor: Harald Schmitt, Munich (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/462,843

(22) Filed: Jun. 17, 2003

(65) Prior Publication Data

US 2003/0230989 A1 Dec. 18, 2003

(30) Foreign Application Priority Data

Jun. 17, 2002 (DE) ..... 102 26 899

(51) Int. Cl.[7] ..... G05F 1/00
(52) U.S. Cl. ..... 315/309; 315/311; 315/323
(58) Field of Search ..... 315/309, 307, 315/308, 310, 311, 323, 324, 209 R, 325, 322, 312

(56) References Cited

U.S. PATENT DOCUMENTS 3,924,155 A * 12/1975 Vogeli ..... 315/97
4,145,638 A * 3/1979 Kaneda ..... 315/323
4,866,350 A * 9/1989 Counts ..... 315/209 R
6,201,354 B1 * 3/2001 Kokubo ..... 315/194
6,518,707 B2 * 2/2003 Gershen et al. ..... 315/129

* cited by examiner

*Primary Examiner*—Tuyet Thi Vo

(57) ABSTRACT

An apparatus for operating a plurality of discharge lamps is to be designed so as to be more cost-effective. A first current control device, in particular a heat-sensitive resistor having a positive temperature coefficient, is connected in parallel with a first contact device for electrically connecting a first discharge lamp. Furthermore, a second contact device for electrically connecting a second discharge lamp is connected in parallel with a second current control device, the first and second contact devices being connected in series. A defined preheating period for the lamps can therefore be achieved. By using a sequential starting capacitor in parallel with one of the lamps, impermissible load current surges may be avoided.

6 Claims, 3 Drawing Sheets

APPARATUS FOR OPERATING DISCHARGE LAMPS

TECHNICAL FIELD

The invention relates to an apparatus for operating discharge lamps having a contact device for electrically connecting a discharge lamp, which has two incandescent filaments, and a current control device, which is connected in parallel with the contact device, for controlling the current through the two incandescent filaments. The present invention relates in particular to electronic ballasts in which such an apparatus is integrated. The operation of the discharge lamps in this case includes both the starting and burning phases.

BACKGROUND ART

It is known for two discharge lamps to be operated using two load circuits. Here, the load on a bridge which is used as an inverter to operate a discharge lamp is referred to as the load circuit. Each load circuit has a dedicated preheating arrangement for each lamp. The possibility of operating two lamps in one load circuit is also known. Here, the primary coil of a heater transformer is connected in parallel with two lamps connected in series, and the secondary coil of the heater transformer is connected between the two lamps.

The circuitry of the load circuits is comparatively complex since electronic control circuits having relay or transistor switches are required for the defined, sequential starting and subsequent joint operation of the lamps. In order to operate individual lamps, on the other hand, there are comparatively favorable control circuits which use only passive components to control the preheating. An essential constituent of such circuits is a heat-sensitive resistor having a positive temperature coefficient.

FIG. 1 shows a bridge circuit having a load circuit associated with it. For inversion purposes, the bridge is in the form of a half-bridge having two switching elements 1 and 2 and two capacitors 3 and 4. The load circuit 5 in the bridge comprises a coil 6 in series with a lamp 7 which is connected in parallel with both a resonant capacitor 8 and a heat-sensitive resistor 9.

The method of operation of the circuit shown in FIG. 1 is explained below. By driving the switches 1 and 2 in a suitable manner, an a.c. voltage is generated from the d.c. voltage for the load circuit 5 in the central tap of the bridge. For the starting process of the lamp, the frequency of the a.c. voltage is preferably in the region of the resonant frequency of the coil 6 and the capacitor 8. Prior to starting, the resistor 9 having a positive temperature coefficient acts as a PTC thermistor mistuning the series tuned circuit 6, 8 such that the necessary starting voltage across the lamp 7 or the capacitor 8 is not reached. However, current is already flowing through the incandescent filaments 10 and 11 of the lamp 7, with the result that the incandescent filaments 10 and 11 are preheated for the starting process. At the same time, current also flows through the PTC thermistor 9 and heats it in this preheating phase. In the process, the resistance of the PTC thermistor 9 increases, causing the mistuning of the series resonant circuit 6, 8 to be correspondingly reduced, with the result that the starting voltage may be reached across the lamp 7. The PTC thermistor 9 is designed such that even after starting it carries a sufficient amount of current for it to still have a high resistance, with the result that the resonance can be maintained with an appropriate Q-factor.

For the sake of clarity, FIG. 2*a* shows the load circuit 5 without the coil 6. FIG. 2*b* shows a variant of the load circuit in FIG. 2*a*. A series capacitor 12 is connected in series with the PTC thermistor 9. This causes the mistuning of the resonant circuit by the PTC thermistor 9 to be not as pronounced as in the case of the circuit in FIG. 2*a*. This means that, in this case, the starting voltage is achieved more quickly and, as a result, the lamp starts more quickly.

A further variant of the load circuits shown in FIGS. 2*a* and 2*b* is depicted in FIG. 2*c*. In this case, the series capacitor 12 is the primary governing factor when the PTC thermistor 9 is in the cold state, whereas in the warm state of the PTC thermistor 9, i.e. during operation and starting of the lamp, the primary governing factor is the series circuit of the two capacitors 8 and 9.

DESCLOSURE OF THE INVENTION

The object of the present invention is to propose a cost-effective preheating circuit for operating two lamps.

This object is achieved according to the invention by means of an apparatus for operating at least two discharge lamps having a first contact device for electrically connecting a first discharge lamp, which has two first incandescent filaments, and a first current control device, which is connected in parallel with the first contact device, for controlling the current through the two first incandescent filaments, and a second contact device for electrically connecting a second discharge lamp, which has two second incandescent filaments, and a second current control device, which is connected in parallel with the second contact device, for controlling the current through the two second incandescent filaments, the first and second contact devices being connected in series.

The advantage of the circuit according to the invention is that the complexity required, in addition to the preheating circuit for one lamp, for preheating a second lamp comprises only one component, namely a second PTC thermistor.

In an advantageous refinement, a resonant capacitor is connected in parallel with the apparatus according to the invention. Both lamps can thus be operated using one resonant circuit.

Alternatively, in each case one resonant capacitor may also be connected in parallel with the first and/or second current control device.

The current control device advantageously has a PTC thermistor with a positive temperature coefficient. This component makes it possible for the preheating for the lamps to be controlled in a comparatively simple and cost-effective manner. In place of the PTC thermistors, the first and/or second current control device may have a transistor. This allows the preheating to be controlled in a more individual, but more complex, manner.

A series capacitor may be connected in series with the first or second current control device. This causes the resonant circuit to be mistuned to a lesser extent, overall, and the respective lamp to be started correspondingly earlier.

A sequential starting capacitor may be provided in parallel with the first and/or second contact device. This sequential starting capacitor advantageously makes it possible to control the sequential starting order for at least two lamps.

In a preferred embodiment, the PTC thermistors of the first and the second current control devices are designed in relation to one another such that the first and second lamps are started sequentially. By this means it is possible to avoid sequential starting in a cost-effective manner and without using further components, for the purpose of preventing intermediate circuit capacitors in so-called energy feedback circuits (pump circuits) from being overloaded.

The apparatus may also preferably be connected to an induction coil, by means of which the apparatus can be operated at resonance. It is thus possible for the apparatus to be driven by an individual inverter for operating two or more lamps.

The apparatus according to the invention is advantageously integrated in an electronic ballast for fluorescent lamps. It is thus possible for two or more lamps to be operated using one ballast.

BRIEF DESCRIPTION OF THE DRAWINGS

The invention will now be explained in more detail with reference to drawings, in which.

BEST MODE FOR CARRYING OUT THE INVENTION

The embodiments described below are only preferred embodiments of the present invention.

Figure 3A:
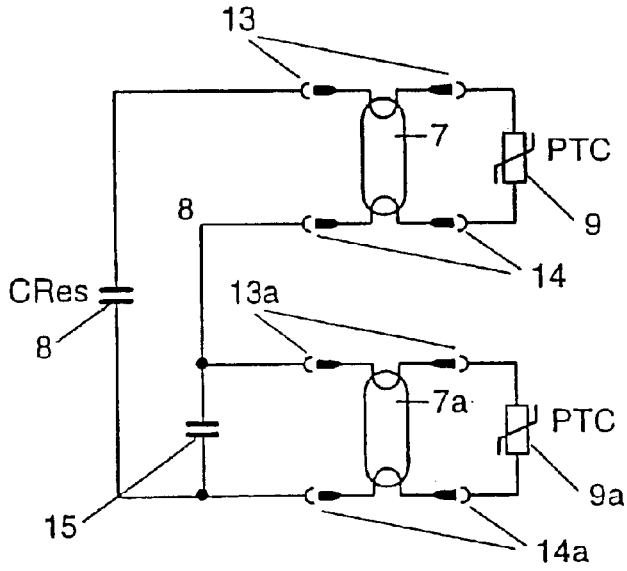
FIGS. 3*a* to 3*d* show variants of load circuits according to the invention for operating at least two lamps.

In FIG. 3*a*, two lamps 7 and 7*a*, or their contact devices 13, 14 and 13*a*, 14*a*, are connected in series. Connected in parallel with the first lamp 7 or first contact device 13, 14 is a first current control device which is in the form of a PTC thermistor. Likewise connected in parallel with the second lamp 7*a* or the second contact device 13*a*, 14*a* is a second current control device 9*a* which is likewise in the form of a heat-sensitive PTC thermistor.

The two PTC thermistors 9, 9*a* mistune the resonant load circuit, the induction coil of which is not shown in the figure. Directly after the apparatus has been switched on, the two PTC thermistors 9, 9*a* have low resistance. The lamps 7, 7*a* have not yet started and the current flowing through the lamps is used exclusively for heating the incandescent filaments. Since the resonant circuit is mistuned, the voltage across the individual lamps is insufficient to start them.

After a certain preheating period in which, in addition to the incandescent filaments, the PTC thermistors 9, 9*a* are also heated, the latter always have a high resistance, as a result of which the mistuning of the resonant circuit is reduced and the voltage across the lamps increases. If, in the starting phase, the PTC thermistor 9 has a higher resistance than the PTC thermistor 9*a*, the lamp 7 starts prior to the lamp 7*a*. The same applies in the reverse case. Since the two PTC thermistors 9, 9*a* are never entirely identical, there will always be one of the two which has a higher resistance than the other in the preheating phase, since they are both heated by the same current.

When one of the two lamps 7, 7*a* has started, a large proportion of the current flows through the started lamp and no longer flows through the associated PTC thermistor. However, sufficient current does flow through this resistor for it to still have a sufficiently high resistance for the lamp not to be extinguished. If the resistance of the PTC thermistor were to become too low in the burning phase of the lamp, the operating current could no longer flow through the lamp but would flow through the PTC thermistor.

Once the first lamp has started, the resistance of the PTC thermistor of the second lamp increases further, with the result that, ultimately, there is also sufficient voltage across the second lamp to start it. Once the two lamps have started, essentially all the current flows through them, whereas only a small proportion of the current now flows through the parallel-connected PTC thermistors 9, 9*a* in order to maintain their high resistance values.

The sequential starting of the lamps 7, 7*a* is necessary in order to limit the current through the individual components. If, however, the sequential starting of the two lamps 7, 7*a* takes place too quickly in succession, the respective current peaks will be superimposed on one another so that the maximum permissible current is exceeded, resulting in the apparatus being switched off. It is therefore necessary to ensure that there is a minimum time interval between the starting of the two or more lamps. If the two PTC thermistors 9, 9*a* are identical, this is not necessarily ensured. Therefore, a sequential starting capacitor 15 is connected in parallel with the lamp 7*a*. The sequential starting capacitor 15 causes the PTC thermistor 9*a* to heat up more slowly than the PTC thermistor 9 in the preheating phase. The PTC thermistor 9*a* therefore has a low value for longer than the PTC thermistor 9. The lamp 7 therefore starts before the lamp 7*a*. The time difference may be set in a defined manner by selecting the capacitance of the sequential starting capacitor 15. This also makes it possible to avoid excessively high load current surges for loading intermediate circuit capacitors in energy feedback circuits.

In FIG. 3*a*, the PTC thermistor 9*a* and the sequential starting capacitor 15 are arranged on different sides of the contact devices 13*a* and 14*a*. This means that only the current through the PTC thermistor 9*a* contributes to the preheating of the filaments of the lamp 7*a*. FIG. 3*d* shows a variant of the embodiment shown in FIG. 3*a* in which both the current through the PTC thermistor 9*a* and the current through the sequential starting capacitor 15 contribute to the preheating of the filaments of the lamp 7*a*. This is achieved by the PTC thermistor 9*a* and the sequential starting capacitor 15 being arranged on the same side of the contact devices 13*a* and 14*a*. This variant is preferred if an increased preheating current is desired.

Figure 1:
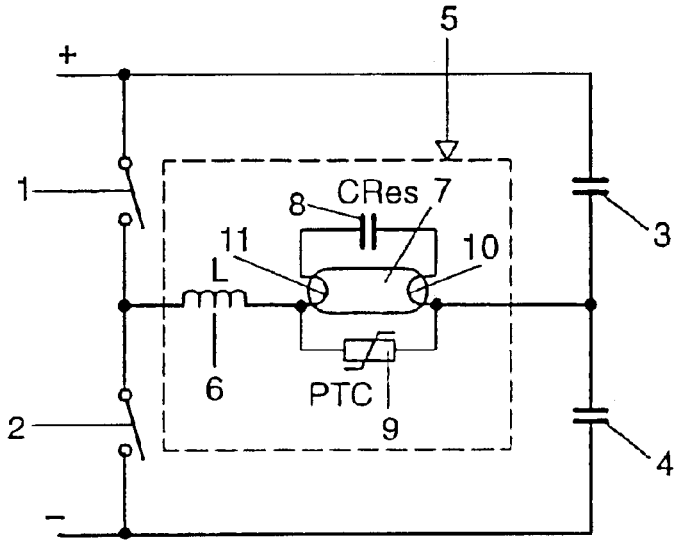
FIG. 1 shows a circuit diagram of a half-bridge having a load circuit according to the prior art for operating a fluorescent lamp.
Figure 2A:
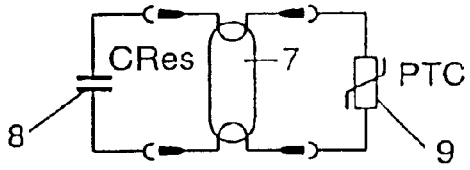
FIGS. 2*a*, 2*b*, 2*c* show variants of load circuits according to the prior art.
Figure 2B:
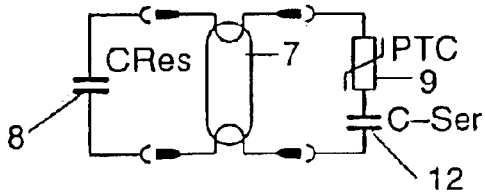
Figure 2C:
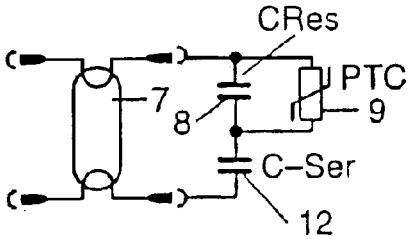
Figure 3B:
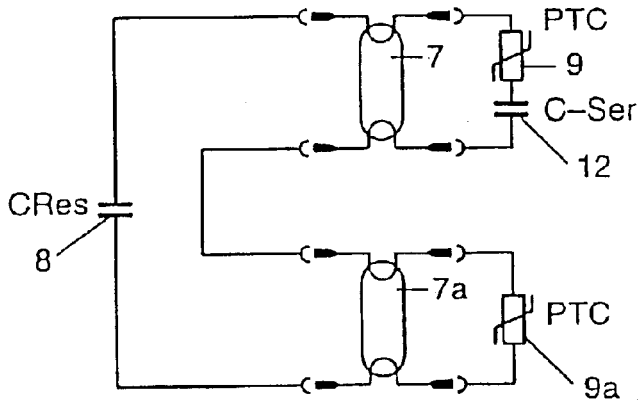

A further variant of the embodiment shown in FIG. 3*a* is depicted in FIG. 3*b*. A series capacitor 12 is connected in series with the PTC thermistor 9. This causes, as already explained in relation to FIG. 2*b*, both PTC thermistors 9, 9*a* to reach their high resistance level more quickly due to the increased current. If the lamp 7 starts first, the increased current is no longer available for heating the PTC thermistor 9*a*.

Figure 3C:
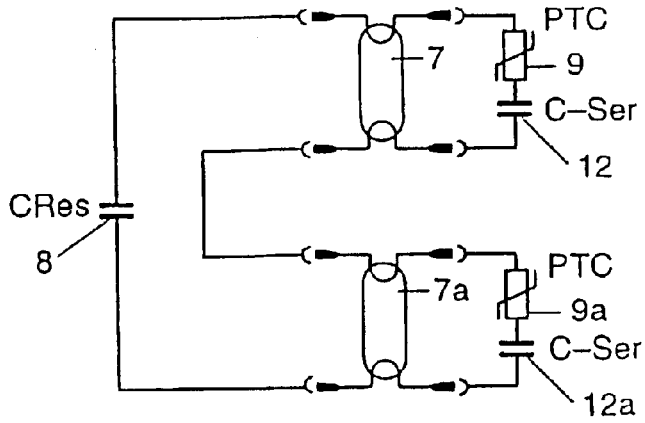
Figure 3D:
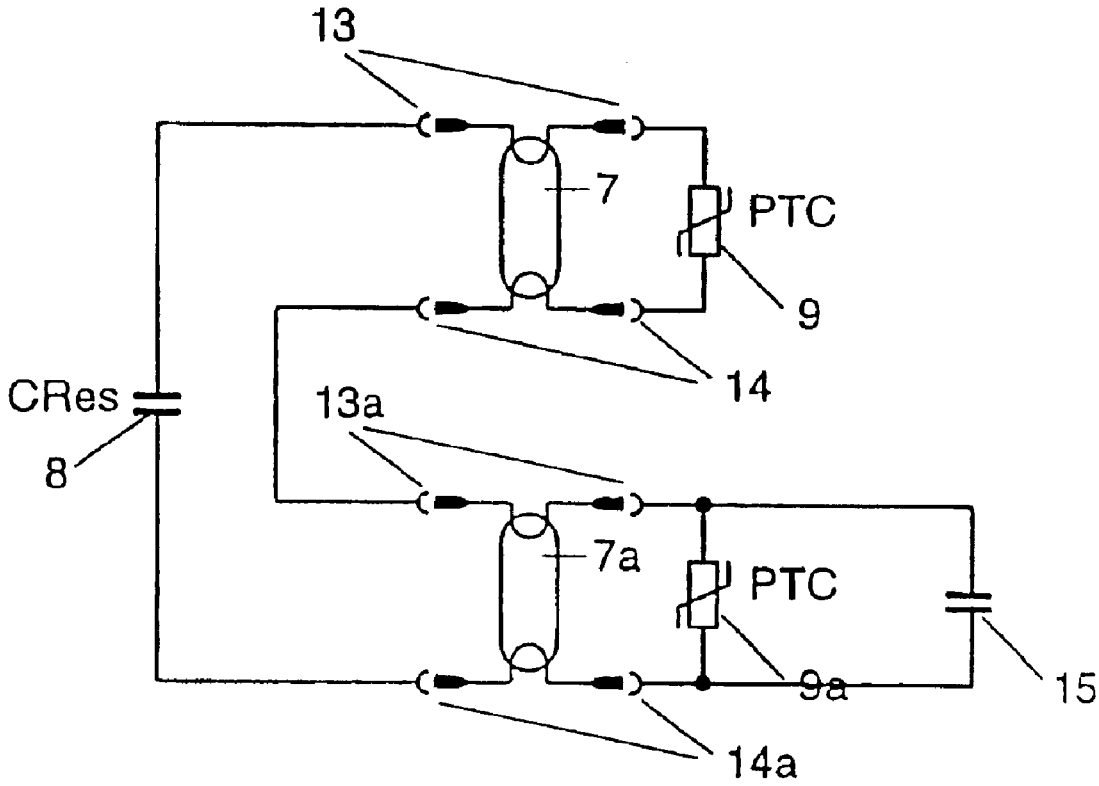

A further variant of the apparatus according to the invention for operating a lamp, i.e. for preheating, igniting and allowing a lamp to burn, is shown in FIG. 3*c*. Here, a series capacitor 12 or 12*a*, respectively, is connected in series with the PTC thermistor 9 and the PTC thermistor 9*a*, respectively. These series capacitors 12, 12*a* ensure that the increased heating current is also available for the subsequently igniting lamp or its PTC thermistor.

It is, of course, also possible to provide a sequential starting capacitor 15 in the embodiments according to FIGS. 3*b* and 3*c* in order to avoid impermissible load current surges.

What is claimed is:

1. An apparatus for operating at least two discharge lamps, comprising:

a first contact device (13,14) for electrically connecting a first discharge lamp (7) having two first incandescent filaments, a second contact device (13*a*,14*a*) for electrically connecting a second discharge lamp (7*a*) having two second incandescent filaments, wherein the first and second contact devices are connected in series, a first PTC thermistor (9), connected in parallel with the first contact device, for controlling the current through the two first incandescent filaments, a second PTC thermistor (9*a*), connected in parallel with the second contact device, for controlling the current through the two second incandescent filaments, a resonant capacitor (8) connected in parallel with the first and second contact devices, and a first series capacitor (12) connected in series with the first PTC thermistor.

2. The apparatus of claim 1, further comprising a second series capacitor (12*a*) connected in series with the second PTC thermistor.

3. The apparatus of claim 1, further comprising a sequential starting capacitor (15) connected in parallel with one of: (i) the first contact device; and (ii) the second contact device.

4. The apparatus of claim 1, wherein the first and second PTC thermistors are designed in relation to one another such that the first and second lamps are started sequentially.

5. The apparatus of claim 2, further comprising a sequential starting capacitor (15) connected in parallel with one of: (i) the first contact device; and (ii) the second contact device.

6. The apparatus of claim 2, wherein the first and second PTC thermistors are designed in relation to one another such that the first and second lamps are started sequentially.

* * * * *